United States Patent [19]

Fenn

[11] 4,263,233

[45] Apr. 21, 1981

[54] FUEL PREPARATION FOR INTERNAL COMBUSTION ENGINES

[75] Inventor: Gordon W. Fenn, Rochester, Mich.

[73] Assignee: Chrysler Corporation, Highland Park, Mich.

[21] Appl. No.: 83,087

[22] Filed: Oct. 9, 1979

[51] Int. Cl.[3] ..... F02M 29/04

[52] U.S. Cl. ..... 261/78 R; 261/DIG. 56; 261/44 E; 261/DIG. 39

[58] Field of Search ..... 261/78 R, 78 A, DIG. 39, 261/DIG. 56, 44 E

[56] References Cited

U.S. PATENT DOCUMENTS

| | | | |
|---|---|---|---|
| 1,998,784 | 4/1935 | Mock | 261/83 |
| 2,102,113 | 12/1937 | Djordjevitch | 261/78 R |
| 2,704,659 | 3/1955 | Fuchs | 261/DIG. 39 |
| 2,714,503 | 8/1955 | Heisler | 261/78 R |
| 2,720,197 | 10/1955 | Titus | 123/122 |
| 2,826,400 | 3/1958 | Sterner et al. | 261/78 R |
| 3,302,374 | 2/1967 | Szekely | 261/78 A |
| 3,326,538 | 6/1967 | Merritt | 261/78 R |
| 3,393,984 | 7/1968 | Wisman | 48/180 |
| 3,559,963 | 2/1971 | Cedarholm | 261/69 R |
| 3,935,851 | 2/1976 | Wright et al. | 123/139 E |
| 4,049,758 | 9/1977 | Englert et al. | 261/62 |
| 4,088,715 | 5/1978 | Graybill | 261/36 A |
| 4,118,444 | 10/1978 | Abbey | 261/44 A |
| 4,119,068 | 10/1978 | Csonka et al. | 261/44 B |
| 4,132,204 | 1/1979 | Teague | 261/DIG. 39 |
| 4,132,752 | 1/1979 | Petermann | 261/40 |
| 4,139,583 | 2/1979 | Riley et al. | 261/DIG. 56 |

FOREIGN PATENT DOCUMENTS

| | | | |
|---|---|---|---|
| 838969 | 5/1952 | Fed. Rep. of Germany | 261/78 R |
| 880821 | 7/1953 | Fed. Rep. of Germany | 261/78 R |
| 840754 | 3/1939 | France | 261/78 R |
| 246489 | 1/1927 | United Kingdom | 261/DIG. 39 |

*Primary Examiner*—Tim R. Miles
*Attorney, Agent, or Firm*—Newtson & Dundas

[57] ABSTRACT

Improved fuel preparation for an internal combustion engine wherein a concave, upstream-facing dispersion surface terminates in a sharp downstream edge with an undercut immediately downstream of the edge and liquid fuel is sprayed under pressure through orifices onto the dispersion surface and allowed to spread out and be sheared by the induction air from the dispersion surface at the sharp edge thereof.

3 Claims, 9 Drawing Figures

FUEL PREPARATION FOR INTERNAL COMBUSTION ENGINES

BACKGROUND AND SUMMARY OF THE INVENTION

This invention pertains to fuel preparation for internal combustion engines and is more particularly concerned with improvements for atomizing liquid fuel by means of a dispersion surface disposed in the induction passage and onto which fuel is sprayed.

In order to improve engine fuel economy and minimize noxious exhaust gas components it is desirable to provide improved fuel atomization preparatory to combustion. The prior art contains a large variety of such arrangements for improving fuel atomization. The present invention is concerned with a new and improved arrangement for fuel atomization which may be used to advantage in an electronic fuel metering system of the type disclosed in U.S. Pat. No. 3,935,851 assigned to the same assignee as the present application. However, the principles involved in the present invention permit its practice with other types of systems. One advantage of the present invention is that a significant improvement in fuel atomization can be achieved without a great deal of complicated hardware, and this means that the invention can be incorporated with a very significant cost benefit.

The foregoing features, advantages and benefits of the invention, along with additional ones, will be seen in the ensuing description and claims which should be considered in conjunction with the accompanying drawings. The drawings disclose a presently preferred embodiment of the invention according to the best mode presently contemplated in carrying out the invention.

DESCRIPTION OF THE PREFERRED EMBODIMENT

Figure 1:
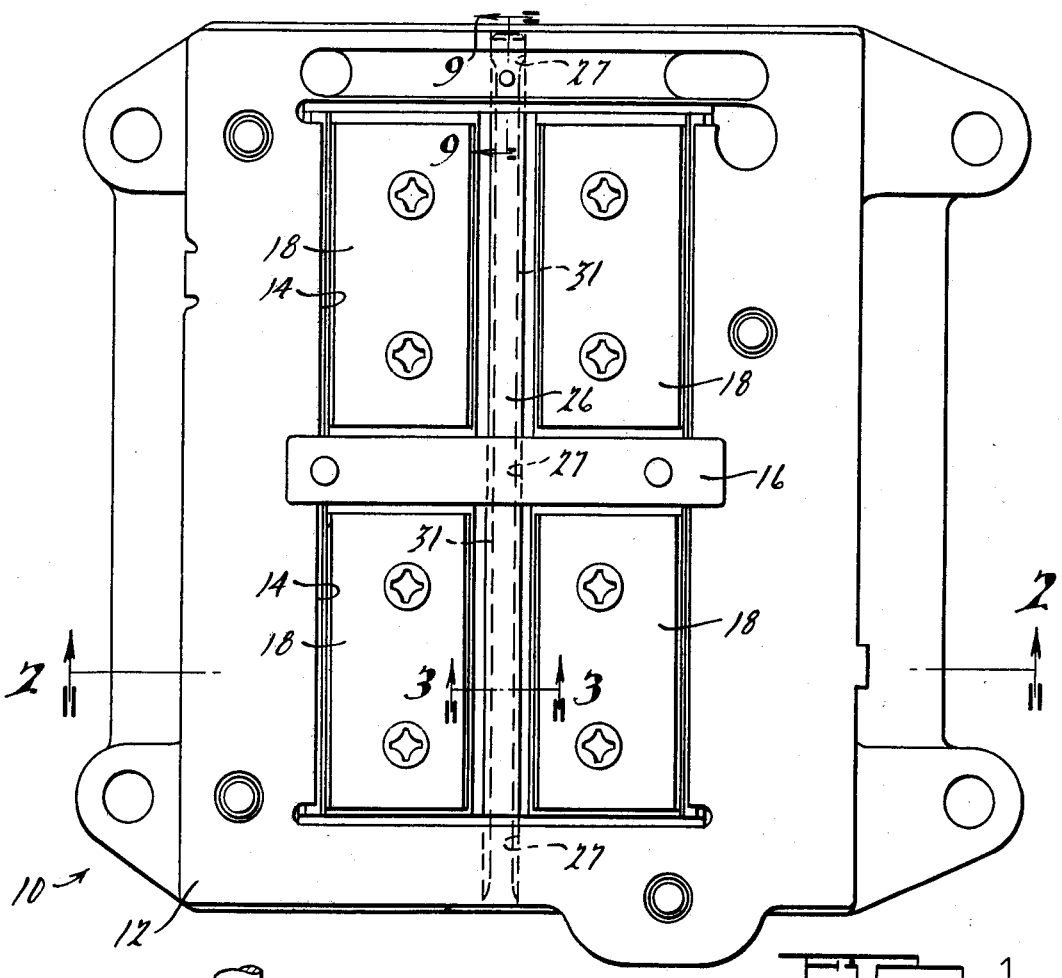
FIG. 1 is a top plan view of a portion of a throttle body assembly embodying principles of the present invention.
Figure 2:
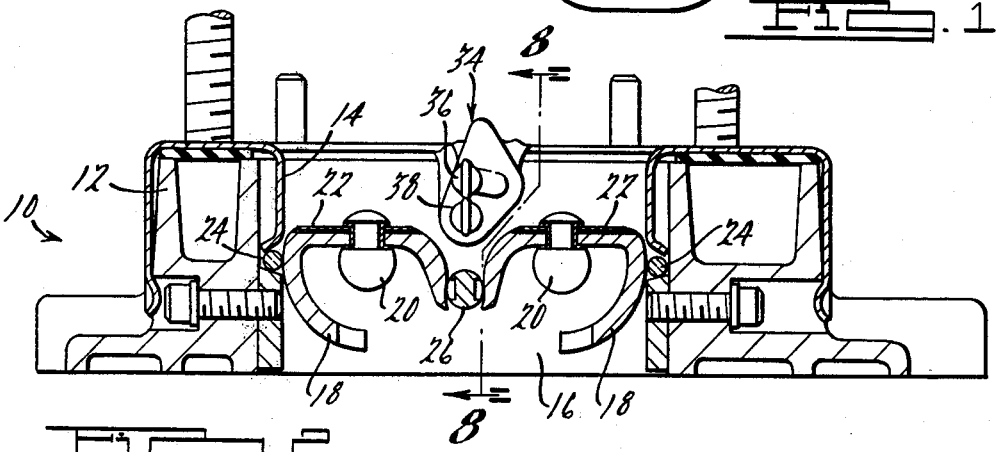
FIG. 2 is a sectional view taken in the direction of arrows 2—2 in FIG. 1 and shows additional structure.

FIGS. 1 and 2 show a throttle body assembly 10 incorporating principles of the present invention. Throttle body 10 is of the same general type as shown in U.S. Pat. No. 4,132,204 and allowed U.S. application Ser. No. 860,926 now U.S. Pat. No. 4,139,583 (both assigned to the same assignee as the present application) and a detailed description thereof will not be repeated here in the interest of brevity. Briefly, the throttle body assembly comprises a throttle body 12 having a pair of rectangular induction passage ports 14 which are separated from each other by a vertical partition 16. Contained within each port of the induction passage are a pair of counter-rotatable throttle blades 18 which are affixed to shafts 20 which counter-rotate in unison by means of appropriate mechanism which is not shown in the drawings. FIGS. 1 and 2 show the throttle blades in the full closed position. Seals for sealing the throttle blades with respect to the walls of the induction passage ports include wiper type seals 22 disposed on the top of each blade and roller type seals 24 disposed at the side of each blade. A more detailed description of these elements is unnecessary for disclosing principles of the present invention, and the reader is referred to the immediately foregoing patent and patent application if he desires further information.

Figure 3:
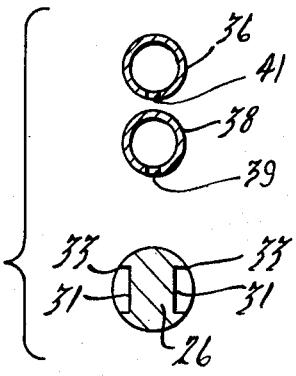
FIG. 3 is an enlarged fragmentary sectional view taken in the direction of arrows 3—3 in FIG. 1 and shows additional structure.
Figure 9:
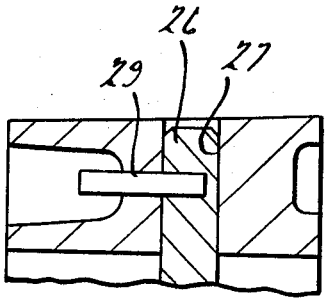
FIG. 9 is a fragmentary sectional view on an enlarged scale taken in the direction of arrows 9—9 in FIG. 1.

Pursuant to principles of the present invention there is provided between the juxtaposed edges of the blades of each pair a circular, cylindrical fuel dispersion element 26 which is transverse to the flow through the passage ports and extends through circular holes 27 in partition 16 and the front and rear walls of the throttle body. As seen in FIG. 9, the dipersion element is locked in place by means of a pin 29 which is inserted through a suitable hole in the throttle body and pressed into a suitable radial hole adjacent one end of the element. FIG. 2 illustrates the throttle blades in the fully closed position in which the juxtaposed edges contact dispersion element 26. FIG. 3 shows greater detail where the specific preferred embodiment of the dispersion element is a rod of circular cross section having a pair of generally rectangularly shaped grooves 31 cut in diametrically opposite sides thereof. The grooved element thus has a cross sectional shape comprising a convex, upstream-facing surface which is bounded on opposite sides by the two grooves to provide sharp edges 33.

Figure 8:
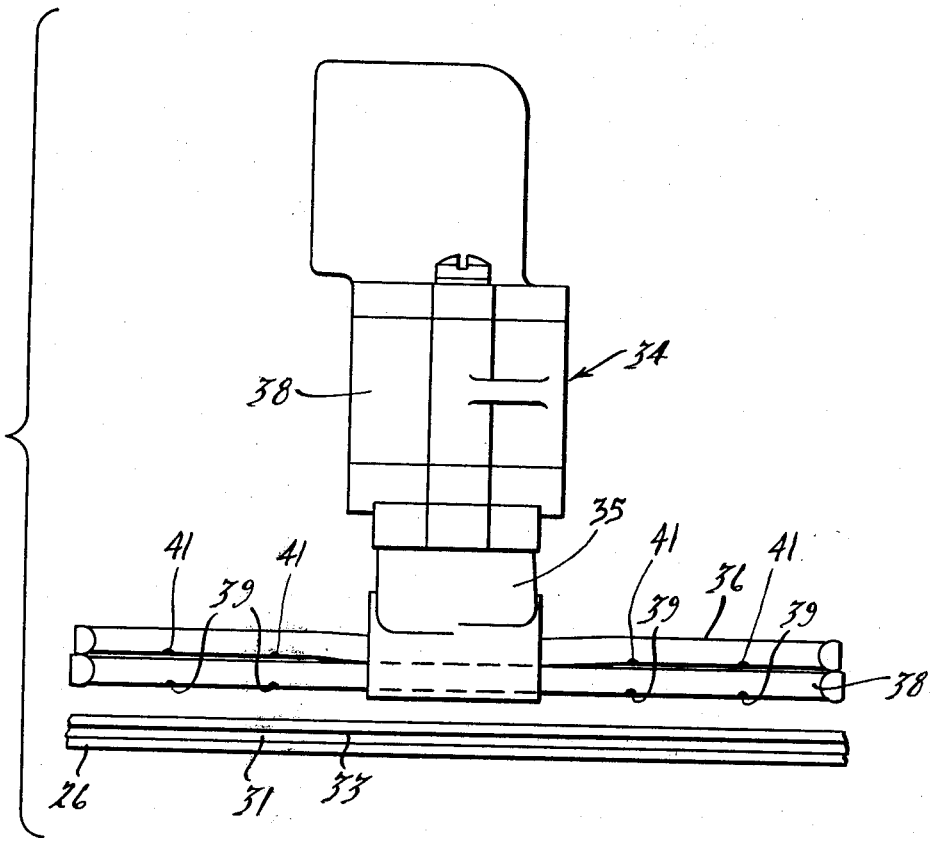
FIG. 8 is a view, taken in the direction of arrows 8—8 in FIG. 2 and showing further structure.

The illustrated dispersion element is shown in use with a spray bar and pressure regulator assembly 34 of the type disclosed in the application entitled "Fuel Spray Bar Assembly for Internal Combustion Engines", Ser. No. 083,086, assigned to the same assignee as the present application and filed of even date herewith. Assembly 34 is shown by itself in FIG. 8 and comprises a body 35 which mounts on partition 16 and a pair of spray tubes 36, 38 which extend from opposite sides of the spray bar body and project into the respective induction passage ports 14. The lower, or downstream, spray tube 38 is spaced upstream of and parallel to the dispersion element and contains orifices 39 arranged to spray fuel directly onto the convex upstream surface of dispersion element 26. The upper spray tube 36 is an auxiliary, or power, tube and contains orifices 41 which spray fuel onto spray tube 38 when extra power is demanded, as explained in said last-mentioned application.

Figure 4:
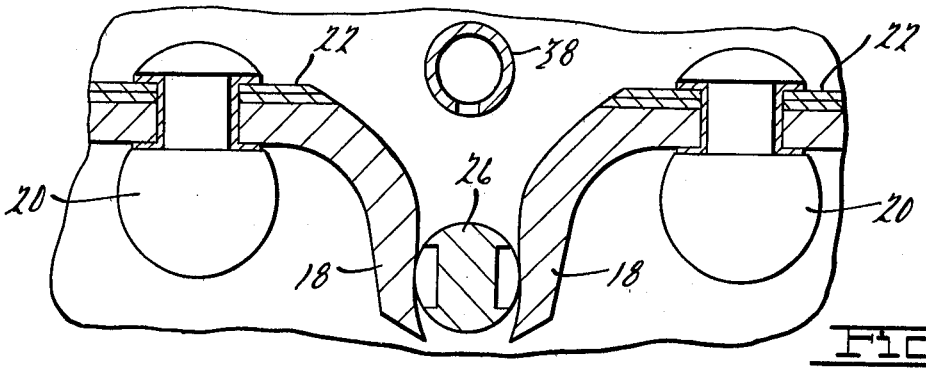
FIGS. 4, 5, 6 and 7 are fragmentary sectional views on an enlarged scale, of a portion of FIG. 2 showing different operative positions.
Figure 5:
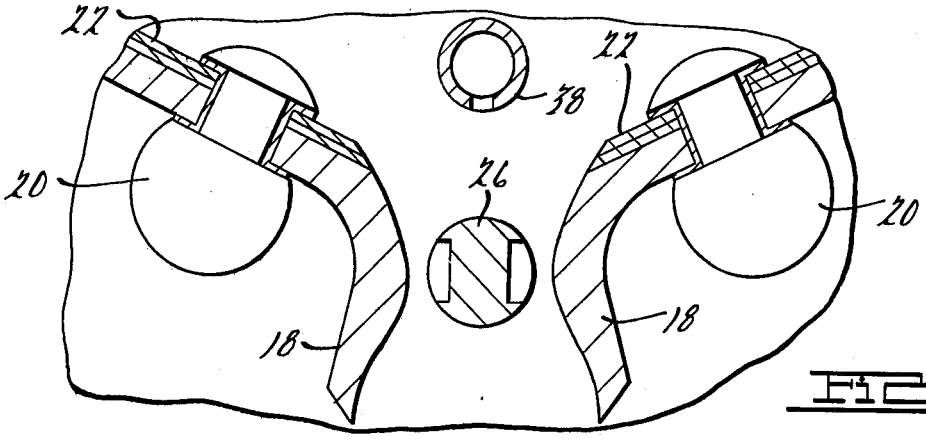
Figure 6:
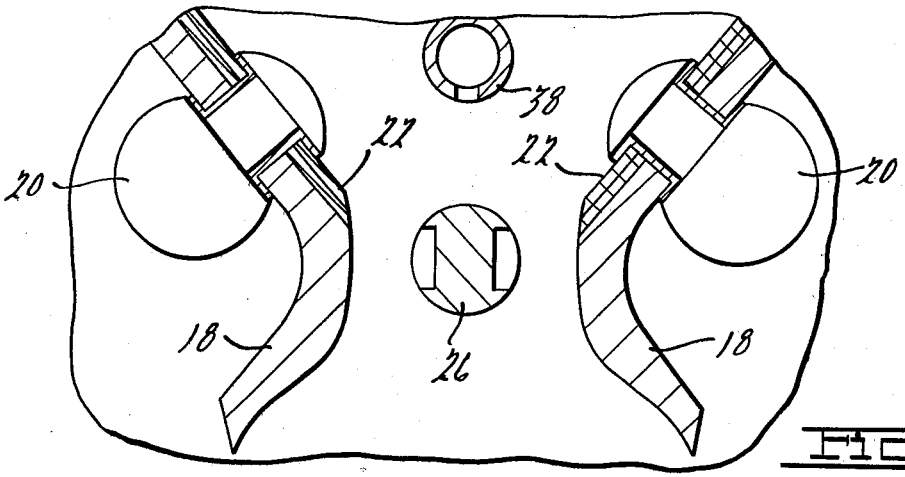
Figure 7:
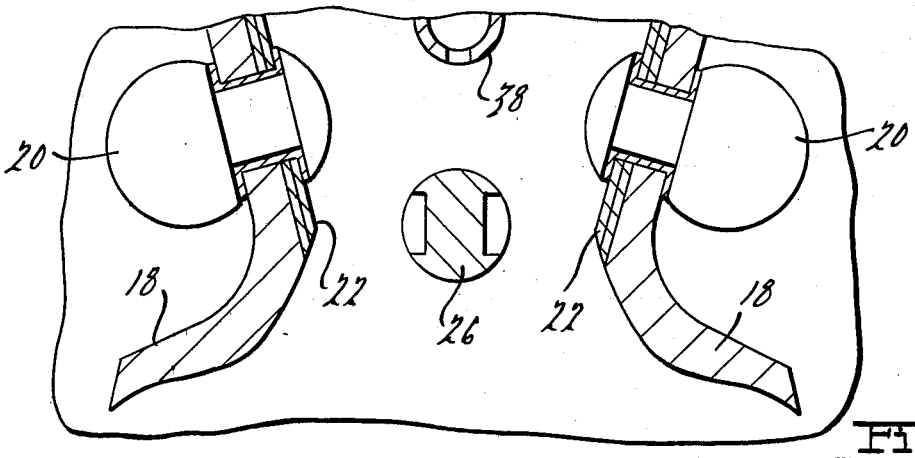

FIGS. 4 through 7 illustrate a series of different operative positions of the throttle blades wherein the size of the effective opening progressively increases from top to bottom of the drawing sheet. Thus, FIG. 4 represents the closed position where there would be no flow through the throttle body. FIG. 5 would represent a typical position for a light engine load where the throttle blades are partly open. FIGS. 6 and 7 illustrate two different throttle positions encountered at higher engine loads.

During modes of operation where light or moderate engine load conditions are encountered, only the lower spray tube 38 sprays fuel. The sprayed fuel impinges directly on the convex upstream surface of dispersion element 26 where it is allowed to spread out and be sheared from the sharp edges 33 by the induction air which passes through the openings between the throttle blades and the dispersion element. The result is improved atomization of liquid fuel. It is believed that the combination of convex upstream facing surface, sharp edges at which the dispersion surface terminates and immediately downstream undercuts provided by the grooves 31, contribute to the improved performance which is obtained. Although a specific preferred embodiment has been disclosed, it will be appreciated that the principles of the invention can be applied in a variety of specific configurations. Thus, various shapes for the dispersion surface, various types of throttle blades, various types of sprayers can be arranged to operate on principles of the present invention. As can be seen from the disclosed embodiment, the construction is relatively uncomplicated since it only requires the addition of the dispersion element 26 (with appropriate dimension modifications to the blade and port structure) over that structure which is shown in the above referenced U.S. Pat. Nos. 4,132,204 and 4,139,583. Thus, the invention can be practiced without adding a great deal of expense to such a throttle body assembly.

What is claimed is:

1. In an internal combustion engine having structure defining an induction passage and a spray bar for spraying fuel into the induction passage wherein the spray bar comprises a tube disposed transversely of the direction of flow through the induction passage and a plurality of spray orifices disposed along the length and on the downstream facing side thereof for spraying fuel in a direction generally downstream of the induction passage, the improvement comprising a fuel dispersion element disposed parallel to and downstream of the spray bar tube and having a convex upstream facing surface and disposed such that fuel sprayed from the orifices in the spray bar tube impinges upon the upstream surface of the dispersion element, said element having at least one groove which bounds the upstream convex surface thereof so as to provide a sharp edge at which the convex upstream surface terminates across which fuel sprayed onto the upstream surface is sheared by induction air passing across the element to thereby improve atomization of fuel.

2. The improvement set forth in claim 1 wherein the fuel dispersion element comprises two grooves extending lengthwise of the dispersion element defining corresponding sharp edges at which the convex upstream surface terminates.

3. The improvement set forth in claim 1 wherein said convex surface has a circular contour in transverse cross section.

* * * * *